United States Patent [19]

Fricker

[11] Patent Number: 4,658,994

[45] Date of Patent: Apr. 21, 1987

[54] APPARATUS FOR REPLACEABLY MOUNTING A POURING TUBE

[75] Inventor: Robert Fricker, Unteraegeri, Switzerland

[73] Assignee: Stopinc Aktiengesellschaft, Baar, Switzerland

[21] Appl. No.: 743,971

[22] Filed: Jun. 12, 1985

[30] Foreign Application Priority Data

Jun. 19, 1984 [CH] Switzerland ..... 2962/84

[51] Int. Cl.[4] ..... B22D 35/00; F16H 21/44

[52] U.S. Cl. ..... 222/607; 222/515; 222/517; 222/566; 74/106

[58] Field of Search ..... 222/607, 606, 598–600, 222/591, 513, 515, 517, 566, 153; 164/337, 437; 74/106, 520; 193/16

[56] References Cited

U.S. PATENT DOCUMENTS

| | | | |
|---|---|---|---|
| 3,625,088 | 12/1971 | Sundermann | 74/520 |
| 4,222,505 | 9/1980 | Daussan et al. | 222/607 X |
| 4,306,827 | 12/1981 | Tsutsumi et al. | 193/16 |
| 4,525,120 | 6/1985 | Legille et al. | 193/16 |
| 4,559,839 | 12/1985 | Legille et al. | 74/106 |

FOREIGN PATENT DOCUMENTS

| | | | |
|---|---|---|---|
| 874886 | 7/1971 | Canada | 222/607 |
| 124018 | 8/1979 | Japan | 222/607 |
| 1157818 | 7/1969 | United Kingdom . | |
| 0397262 | 2/1974 | U.S.S.R. | 222/607 |

*Primary Examiner*—Joseph J. Rolla
*Assistant Examiner*—Gregory L. Huson
*Attorney, Agent, or Firm*—Wenderoth, Lind & Ponack

[57] ABSTRACT

An apparatus for replaceably mounting a pouring tube in engagement with a discharge nozzle of a vessel includes an arm mounted for pivotal movement about a vertical axis and for tilting movement about a horizontal axis. A first end of the arm has a fixture for supporting a pouring tube. An operating member is mounted adjacent a second end of the arm to tilt the arm about the horizontal axis between a clamping position, where the pouring tube is pressed against a discharge nozzle of a vessel, and an open position, where the pouring tube is spaced from the discharge nozzle. When the arm is in the open position it may be pivoted about the vertical axis between a first position, where the pouring tube is aligned with the discharge nozzle, and a second position, where the pouring tube is spaced from the discharge nozzle. The operating member includes a toggle joint movable between an expanded position and a buckled position, a spring operable between the arm and the toggle joint for biasing the toggle joint to the buckled position thereof, and an actuating member for moving the toggle joint between the buckled position and the expanded position against the force of the spring.

12 Claims, 4 Drawing Figures

APPARATUS FOR REPLACEABLY MOUNTING A POURING TUBE

BACKGROUND OF THE INVENTION

The present invention relates to an apparatus for replaceably mounting a pouring tube in engagement with a discharge nozzle of a vessel, for example a metallurgical vessel. The present invention more particularly is related to such an apparatus including an arm that can be pivoted about a vertical axis mounted on the vessel bottom and which can be tilted about an axis perpendicular thereto, i.e. a horizontal axis, such arm having at a first end thereof a fixture for removably supporting a pouring tube, and such arm having at a second end thereof adjustment means to produce tilting movement of the arm about the horizontal axis for pressing the pouring tube against a discharge nozzle of the vessel and for removing the pouring tube from the discharge nozzle.

This general type of apparatus is known, for example as disclosed in British Patent No. 1,157,818, wherein there is provided as the vertical axis a threaded bolt fastened to the bottom of a metallurgical vessel and on which there is pivotally mounted a forked threaded sleeve which has a horizontal shaft supporting the arm. The arm is connected to the vessel bottom via a turnbuckle which is employed for pivoting the arm about the horizontal shaft to connect and disconnect the pouring tube to the discharge nozzle of the vessel. This arrangement however has a number of inherent disadvantages. Thus, the operation of the turnbuckle is complicated and slow, particularly during times of emergency. Furthermore, cantings cannot be avoided when the pouring tube is pressed against the discharge nozzle of the vessel. Further, there is the danger that, when tightening the turnbuckle, uncontrolled forces arise can easily lead to rupture of various parts of the apparatus. Finally, pivotal movement of the arm about the vertical axis is not possible until the turnbuckle connection is released.

SUMMARY OF THE INVENTION

With the above discussion in mind, it is an object of the present invention to provide an apparatus for replaceably mounting a pouring tube in engagement with a discharge nozzle of a vessel, whereby it is possible to overcome the above and other prior art disadvantages.

It is a further object of the present invention to provide such an apparatus capable of easier and faster operation than is possible with prior art arrangements.

It is a yet further object of the present invention to provide such an apparatus whereby it is possible to ensure safe and accurate mounting of the pouring tube.

These and other objects are achieved in accordance with the present invention by the provision that the operating means for achieving tilting movement of the arm about the horizontal axis between a clamping position and an open position comprises a toggle joint movable between a stretched or expanded position and a compressed or buckled position, spring means operable between the arm and the toggle joint for biasing the toggle joint to the buckled position thereof, and actuating means for moving the toggle joint between the buckled position, whereat the arm pivots to the open position thereof, and the expanded position against the biasing force of the spring means to thereby pivot the arm to the clamping position thereof. In other words, the spring buffer is loaded between the toggle joint and the arm. In this manner, it is possible to replace a pouring tube rapidly, surely and with just a few deft manual movements, since the work required to connect and disconnect the pouring tube is reduced to a minimum. In fact, only two hand motions on the actuating means are required to achieve these movements. Additionally, the toggle joint coacting with the spring means, due to its simple but effective structure, is extremely useful for preliminary operations in a steel mill, particularly since contamination does not impair the serviceability of the toggle joint and spring. Additionally, the provision of the spring enables a uniform, elastically yielding, yet reliable sealing pressure of the pouring tube against a sealing surface of the discharge nozzle of the vessel.

Advantageously, a bearing block is fixed to the vessel, and the toggle joint is mounted on the bearing block, with the spring means mounted on the second end of the arm. The actuating means comprises an actuating member pivotally mounted on the bearing block by a shaft, and the toggle joint comprises a pressure bolt mounted for vertical movement, i.e. parallel to the vertical axis, and acted on by the spring means, and a toggle member or buttstrap member pivotally connected to the actuating member and to the pressure bolt. The pressure bolt is guided for vertical movement within the bearing block. The spring includes a housing, a piston guided by the housing for vertical movement coaxially of the pressure bolt, and at least one spring within the housing and urging the piston toward and into contact with the pressure bolt. An abutment supports the spring and is adjustable with respect to the housing to adjust the pressure between the piston and the pressure bolt. This enables the spring tension to be adjusted with a high degree of precision to meet the requirements of a particular installation.

In accordance with a further aspect of the present invention, the vertical shaft comprises a vertical pin pivotally supported by the bearing block and having a lower forked end supporting a horizontal pin which forms the horizontal axis. The horizontal pin pivotally supports the arm. There is provided detachable locking means for locking the vertical pin to the bearing block with the arm in a position thereof with the pouring tube aligned with the nozzle. The vertical pin includes a horizontal flange, and the locking means is in the form of an opening in the flange and a bar slidably mounted in the bearing block for movement into the opening of the flange when the vertical pin is pivoted to move the arm to the position aligning the pouring tube with the discharge nozzle of the vessel. A locking notch is formed in the bearing block, and a handle on the bar is movable into the locking notch when the bar extends into the opening of the flange of the vertical pin. Additionally, a second notch may be formed in the bearing block at a position to receive the handle when the bar is retracted from the opening. In this manner, there is provided an expedient and structurally simple arrangement of the arm and its axes of motion. Additionally, the operating position of the pouring tube can be readily locked.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
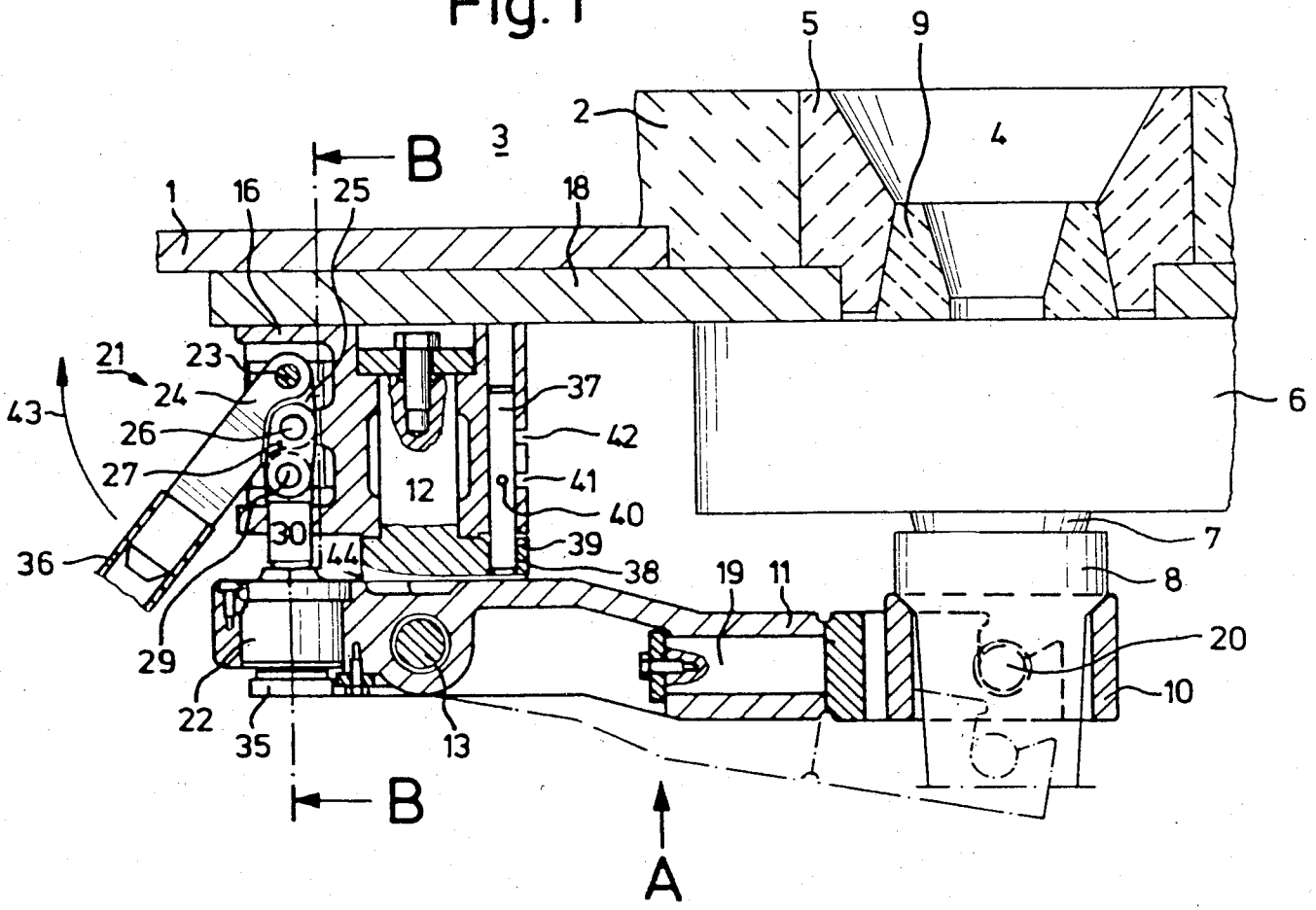
FIG. 1 is an elevation view, substantially in section, of an apparatus according to the present invention shown in position at the bottom of a vessel.
Figure 2:
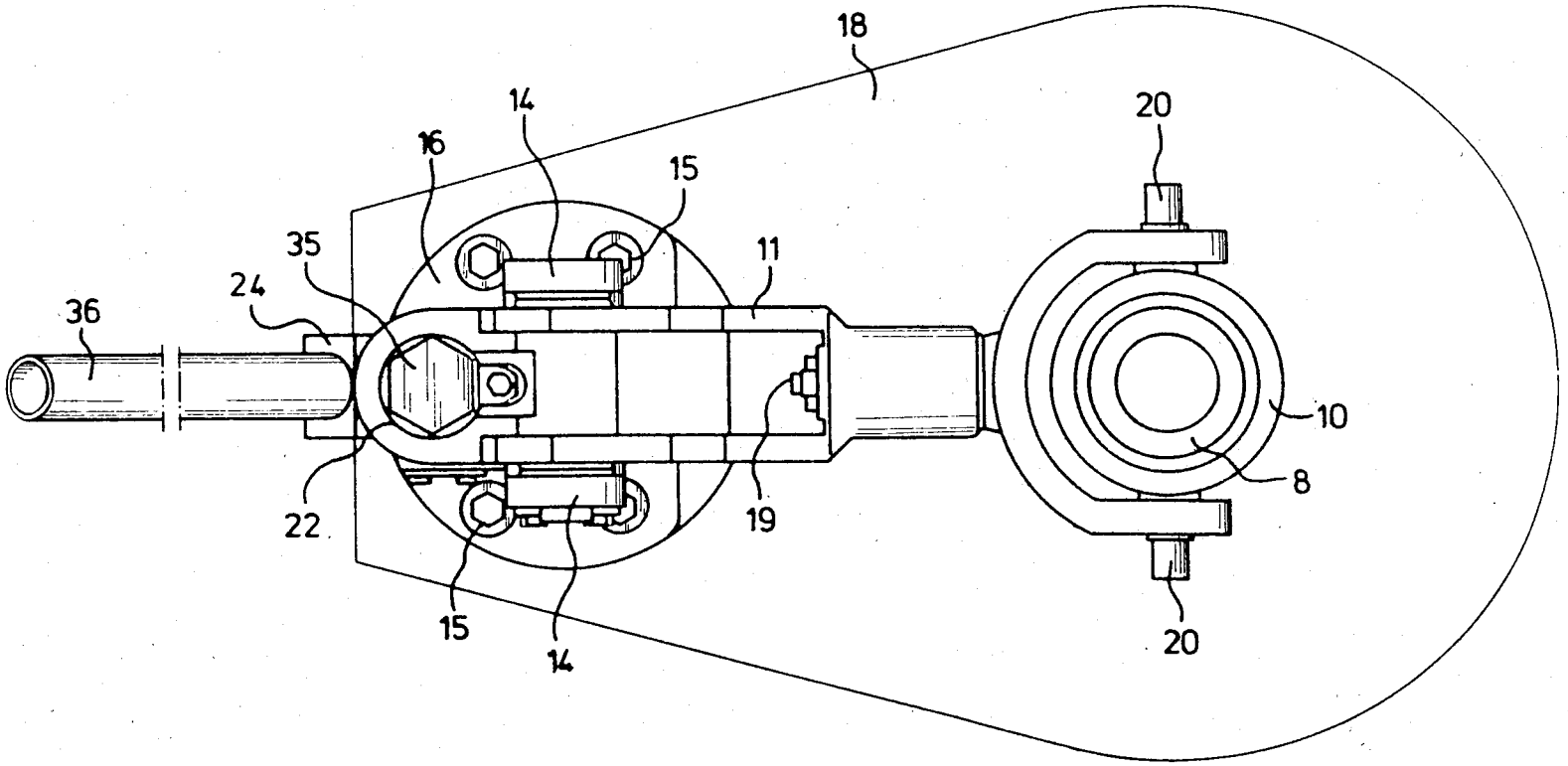
FIG. 2 is a bottom plan view taken in the direction of arrow A of FIG. 1.
Figure 4:
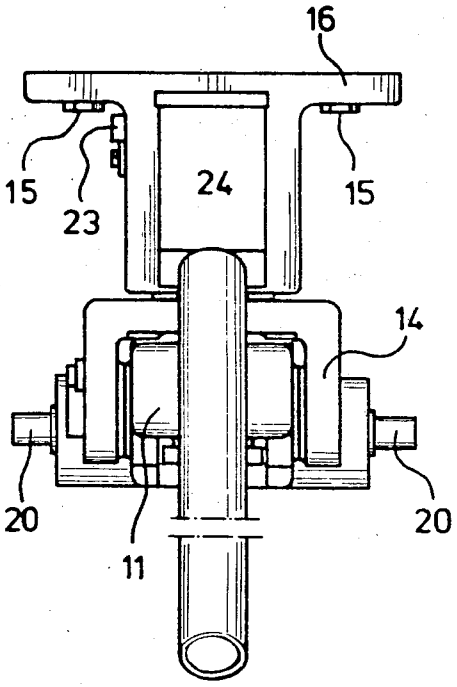
FIG. 4 is an end view, taken from the left of FIG. 2.
Figure 3:
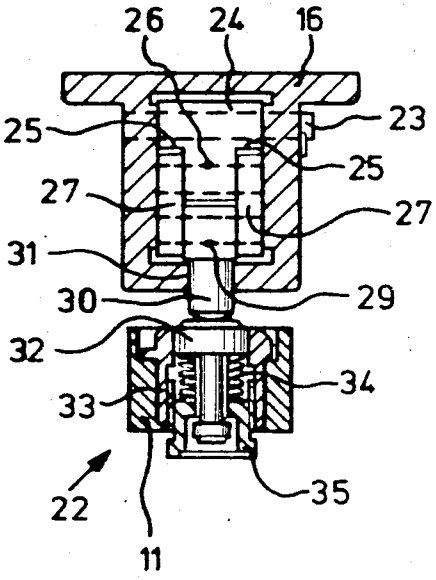
FIG. 3 is a section taken along line B—B of FIG. 1.

In FIG. 1, a vessel 3, for example a tundish for a continuous casting plant, includes a metal bottom 1 and a refractory lining 2 having a nozzle brick 5 with a discharge opening 4 having therein a spout brick 9. Shown schematically at the bottom of the vessel is a sliding closure unit or sliding gate 6 having a nozzle 7 forming a discharge nozzle of the vessel and employed for initiating, controlling and stopping the discharge of molten metal from the vessel. This structure is intended to be conventional and may be of various other specific forms as would be apparent to one skilled in the art.

In the operation of such vessels, a pouring tube 8 is designed as a replaceable refractory wear member which is adapted to be sealingly connected to a lower flat surface of nozzle 7 and held thereagainst by means of the apparatus of the present invention. Thus, the apparatus of the present invention includes an arm 11 mounted for pivotal movement about a vertical axis defined by vertical pin 12 and for tilting movement about a horizontal axis defined by horizontal pin 13 which extends perpendicularly to the axis of vertical pin 12. Arm 11 has on a first end thereof a fixture, for example a bearing sleeve 10 for supporting pouring tube 8. The support of sleeve 10 is a universal gimbal arrangement including a shaft 19 pivotally mounted in arm 11 and supporting a forked member having a pair of notches supporting respective pins 20 of sleeve 10. This enables universal movement of sleeve 10 to ensure proper abutment of pouring tube 8 against the bottom surface of nozzle 7.

A bearing block 16 is fastened, for example by bolts 15, to a mounting plate 18 at the bottom of vessel wall 1. Vertical pin 12 is supported within bearing block 16 for pivoting or rotational movement about a vertical axis. The bottom end of vertical pin 12 is fork shaped as shown at 14, and horizontal pin 13 is rotatably supported by forked ends 14. Pin 13 also rotatably supports arm 11.

The second end of arm 11 has operating means for tilting arm 11 about pin 13 between a clamping position, shown in solid lines in FIG. 1, whereat pouring tube 8 is pressed against discharge nozzle 7, and an open position, shown by dashed lines in FIG. 1, whereat pouring tube 8 is spaced from discharge nozzle 7. Furthermore, this operating means enables arm 11, when in the open position thereof, to be pivoted about vertical pin 12 between a first position, whereat the pouring tube 8 is aligned with discharge nozzle 7, and a second position, whereat the pouring tube is spaced from the discharge nozzle and may be removed from sleeve 10 and replaced by a new pouring tube. Specifically, the operating means is in the form of a toggle joint 21 movable between an expanded position and a buckled position, spring means 22, for example in the form of a springtype shock absorber, operable between arm 11 and toggle joint 21 to bias the toggle joint to the buckled position thereof, and an actuating member 24 for moving the toggle joint 21 between the buckled position, whereat the arm 11 pivots to the open position thereof, and the expanded position against the biasing force of spring 22 to thereby pivot arm 11 to the clamping position thereof.

The actuating member 24 is pivotally mounted to bearing block 16 by a fixed shaft 23. Actuating member 24 has at opposite sides thereof recesses 25 into which extend portions of a toggle member, for example butt-straps 27 which are pivotally connected to actuating member 24 by a pin 26 and which also are pivotally connected to a pressure bolt 30 by means of a pin 29. The pressure bolt 30 is guided for vertical movement within bearing block 16 and passes through a guide hole 31 thereof. Spring means 22 is in the form of a housing 33 mounted within arm 11, a piston 32 guided within housing 33 for vertical movement coaxially of pressure bolt 30, and at least one spring, for example a plurality of cup springs 34, within housing 33 and urging piston 32 upwardly into contact with pressure bolt 30. Springs 34 are supported by an abutment, for example in the form of a screw plug 35, which is adjustable in housing 33 to adjust the spring tension, thereby adjusting the pressure between piston 32 and pressure bolt 30.

The operation of the apparatus now will be described. Thus, in the position illustrated by solid lines in FIG. 1, the toggle joint 21 is expanded and locked, such that arm 11 is pivoted about pin 13 to a position clamping pouring tube 8 against nozzle 7. Actuating member 24 may have mounted thereon a handle 36, or alternatively may include an integral handle, for enabling operation of the actuating member. Thus, by moving actuating member 24 in the direction of arrow 43, actuating member 24 pulls pin 26 to move about shaft 23. This movement causes straps 27 to pivot counterclockwise as viewed in FIG. 1 about pin 29, and this causes pressure bolt 30 to move vertically upward while being guided by opening 31. This unlocks the toggle joint and moves pressure bolt 30 away from spring 22, thereby allowing arm 11 to pivot about pin 13 in a clockwise direction as shown in FIG. 1 due to the weight of the arm and the pouring tube 8. Thus, the arm moves to the open position indicated by dashed lines in FIG. 1, such that pouring tube 8 is disconnected from nozzle 7. At this time, arm 11 may be pivoted, about vertical pin 12, for example by a simple manipulation of actuating member 24, thereby swinging the pouring tube 8 to a position spaced from nozzle 7, whereby the pouring tube 8 may be removed from sleeve 10 and replaced by a new pouring tube.

There also is provided locking means for locking vertical pin 12 to bearing block 16 when the arm 11 is in the position thereof aligning pouring tube 8 with nozzle 7. Thus, vertical pin 12 includes a lower flange 39 having therein an opening 38. A locking bar 37 is vertically slidably mounted within bearing block 16 for movement into opening 38 when pin 12 is pivoted to move arm 11 to a position aligning pouring tube 8 with nozzle 7. It will be apparent that movement of pin 37 into opening 38 will prevent further relative movement of pin 12 with respect to bearing block 16. It also is provided that bar 37 may be prevented from inadvertently releasing pin 12 from the lock position. Thus, bearing block 16 may have formed therein a locking notch 41, and bar 37 may have a handle 40 which may be moved into locking notch 41 when bar 37 extends into opening 38. Additionally, there may be provided a second notch 42 in bearing block 16 at a position to receive handle 40 when the bar 37 is raised to a position retracted from opening 38 to maintain the bar 37 away from flange 39 when it is desired to rotate pin 12 with respect to bearing block 16.

It will be apparent that when the toggle joint is buckled to allow pouring tube 8 to be lowered from nozzle 7, pivotal movement of arm 11 will be limited by an abutment 44 of bearing block 16. It furthermore will be apparent that operation of the apparatus of the present invention is intended to enable rapid and easy replacement of pouring tube 8 when the sliding closure unit 6 is closed and when the vessel 3 is raised as necessary to remove pouring tube 8 from a mold. At such time, upon release of toggle joint 21, the pouring tube 8 is pivoted downwardly. Locking bar 37 then may be retracted from opening 38, and the arm 11 and pouring tube 8 may be swung horizontally away from nozzle 7. The worn pouring tube 8 then may be replaced by a new pouring tube, whereby arm 11 again can be swung horizontally to a position below nozzle 7. Bar 37 then is lowered into opening 38 and locked, and toggle joint 21 is operated to pivot the new pouring tube 8 against nozzle 7.

It will be apparent that the above structural arrangement of the present invention provides an apparatus which can be easily handled and which can be used in a small space. Furthermore, the spring 22 may be provided as a preassembled component which is readily replaceable when necessary.

Although the present invention has been described and illustrated with respect to preferred features thereof, it will be apparent that various changes and modifications may be made to the specifically described and illustrated structure without departing from the scope of the present invention.

I claim:

1. An apparatus for use in replaceably mounting a pouring tube in engagement with a discharge nozzle of a vessel, said apparatus comprising:

an arm having a longitudinal axis;

means mounting said arm for pivotal movement about a vertical axis transverse to said longitudinal axis and for tilting movement about a horizontal axis transverse to said longitudinal axis;

a fixture on a first end of said arm for supporting a pouring tube; and operating means mounted adjacent a second end of said arm for tilting said arm about said horizontal axis between a clamping position, whereat a pouring tube supported by said fixture is pressed against a discharge nozzle of a vessel, and an open position, whereat the pouring tube is spaced from the discharge nozzle, and for enabling said arm when in said open position thereof to be pivoted about said vertical axis between a first position, whereat the pouring tube is aligned with the discharge nozzle, to a second position, whereat the pouring tube is spaced from the discharge nozzle and may be removed from said fixture, said operating means comprising a toggle joint movable between an expanded position and a buckled position, spring means coaxial with said toggle joint in said expanded position thereof and operable between said arm and said toggle joint for biasing said toggle joint to said buckled position thereof, and actuating means for moving said toggle joint between said buckled position, whereat said arm pivots to said open position thereof, and said expanded position against the biasing force of said spring means to thereby pivot said arm to said clamping position thereof.

2. An apparatus as claimed in claim 1, further comprising a bearing block to be fixed to the vessel, said toggle joint being mounted on said bearing block, and wherein said spring means is mounted on said second end of said arm.

3. An apparatus as claimed in claim 2, wherein said actuating means comprises an actuating member pivotally mounted on said bearing block by a shaft, and said toggle joint comprises a pressure bolt mounted for vertical movement and acted on by said spring means, and a toggle member pivotally connected to said actuating member and said pressure bolt.

4. An apparatus as claimed in claim 3, wherein said pressure bolt is guided for vertical movement within said bearing block.

5. An apparatus as claimed in claim 3, wherein said spring means comprises a housing, a piston guided by said housing for vertical movement coaxially of said pressure bolt, and at least one spring within said housing and urging said piston toward said pressure bolt.

6. An apparatus as claimed in claim 5, further comprising abutment means supporting said spring and adjustable with respect to said housing to adjust the pressure between said piston and said pressure bolt.

7. An apparatus as claimed in claim 2, wherein said vertical axis comprises a vertical pin pivotally supported by said bearing block, and said horizontal axis comprises a horizontal pin pivotally supported by said vertical pin and pivotally supporting said arm.

8. An apparatus as claimed in claim 7, wherein said vertical pin has a lower forked end supporting said horizontal pin.

9. An apparatus as claimed in claim 7, further comprising detachable locking means for locking said vertical pin to said bearing block with said arm in said first position thereof.

10. An apparatus as claimed in claim 9, wherein said vertical pin includes a horizontal flange, and said locking means comprises an opening in said flange, and a bar slidably mounted in said bearing block for movement into said opening when said vertical pin is pivoted to move said arm to said first position thereof.

11. An apparatus as claimed in claim 10, wherein said locking means further comprises a locking notch in said bearing block, and a handle on said bar and movable into said locking notch when said bar extends into said opening.

12. An apparatus as claimed in claim 11, further comprising a second notch in said bearing block at a position to receive said handle when said bar is retracted from said opening.

* * * * *